US012760451B2

(12) United States Patent
Dandapure et al.

(10) Patent No.: US 12,760,451 B2
(45) Date of Patent: Oct. 13, 2026

(54) FABRIC AND GARMENTS MADE OF SUCH FABRIC

(71) Applicant: LULULEMON ATHLETICA CANADA INC., Vancouver (CA)

(72) Inventors: Yogendra V Dandapure, Vancouver (CA); Rovin Manna, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 224 days.

(21) Appl. No.: 18/558,007

(22) PCT Filed: May 13, 2022

(86) PCT No.: PCT/CA2022/050760
§ 371 (c)(1),
(2) Date: Oct. 30, 2023

(87) PCT Pub. No.: WO2022/236429
PCT Pub. Date: Nov. 17, 2022

(65) Prior Publication Data

US 2024/0183087 A1 Jun. 6, 2024

Related U.S. Application Data

(60) Provisional application No. 63/188,075, filed on May 13, 2021.

(51) Int. Cl.
*D03D 15/47* (2021.01)
*D02G 1/16* (2006.01)
(Continued)

(52) U.S. Cl.
CPC ..... *D03D 15/47* (2021.01); *D02G 1/165* (2013.01); *D02G 3/045* (2013.01); *D02G 3/36* (2013.01);
(Continued)

(58) Field of Classification Search
CPC ..... D03D 15/47; D03D 15/49; D03D 15/50; D03D 1/00; D02G 3/36; D02G 3/44;
(Continued)

(56) References Cited

U.S. PATENT DOCUMENTS 5,282,846 A * 2/1994 Schmitt ..... D03D 15/573 623/921
2015/0133017 A1 5/2015 Liao et al.
(Continued)

FOREIGN PATENT DOCUMENTS

WO WO-2019038784 A1 * 2/2019 ..... D01D 5/12
WO 2021072323 A1 4/2021

OTHER PUBLICATIONS

Multi-ply (Year: 2019).*
International Search Report and Written Opinion mailed Jul. 21, 2022 for PCT application No. PCT/CA2022/050760.

*Primary Examiner* — Katharine G Kane
(74) *Attorney, Agent, or Firm* — Plumsea Law Group, LLC

(57) ABSTRACT

It is provided a fabric comprises a yarn that is bi-component yarn air texturized with a mechanical stretched synthetic polymer yarn and a high moisture regain yarn with greater fiber weight per filament than the bi-component yarn. The weft yarns are interwoven with the warp yarns such that the woven fabric defines a face side and a back side opposite to the face side. The high moisture regain yarn is inserted such that it generates plurality of long high moisture regain yarn floats such that a majority of the long high moisture regain yarn floats are on the back side of the woven fabric. The high moisture regain yarn can be inserted in weft or in warp direction or can alternate or at different intervals such that the longer floats are on the backside for more exposure to the skin.

19 Claims, 4 Drawing Sheets

(51) Int. Cl.

| | |
|---|---|
| ***D02G 3/04*** | (2006.01) |
| ***D02G 3/36*** | (2006.01) |
| ***D02G 3/44*** | (2006.01) |
| ***D03D 1/00*** | (2006.01) |
| ***D03D 15/49*** | (2021.01) |
| ***D03D 15/50*** | (2021.01) |

(52) U.S. Cl.
CPC ..... *D02G 3/44* (2013.01); *D03D 1/00* (2013.01); *D03D 15/49* (2021.01); *D03D 15/50* (2021.01); *D10B 2331/04* (2013.01); *D10B 2401/06* (2013.01); *D10B 2403/0114* (2013.01); *D10B 2501/00* (2013.01)

(58) Field of Classification Search
CPC .... D02G 3/045; D02G 1/165; D10B 2403/01; D10B 2501/00
See application file for complete search history.

(56) References Cited

U.S. PATENT DOCUMENTS

| | | | | |
|---|---|---|---|---|
| 2018/0119318 | A1* | 5/2018 | Morales | D03D 1/00 |
| 2019/0309448 | A1 | 10/2019 | Holbert, Jr. et al. | |
| 2019/0309452 | A1* | 10/2019 | Liao | D04B 1/18 |
| 2023/0243074 | A1* | 8/2023 | Dandapure | D03D 15/527 |
| 2024/0100222 | A1* | 3/2024 | Elkhodiry | A61L 27/34 |

* cited by examiner

FABRIC AND GARMENTS MADE OF SUCH FABRIC

TECHNICAL FIELD

It is provided a fabric and garments made of such fabric.

BACKGROUND

Fabrics used in apparel designed for athletic activities are conceived with the objective of maximizing the body performance by notably controlling the body temperature and keeping the moisture away from the individual. The challenge is to manufacture such apparel which generally exhibit characteristics that enhance the performance without compromising the appearance and/or comfort of an individual. The moisture from the associated sweat generated as a result of physical exertion causes undesirable liquid spot on the face surface of the apparel. Having a fabric that reduces occurrence of moisture spots is convenient for wearers that can work out in a athletic gear and walk to get groceries or coffee without worrying about sweat marks. Having a fabric that has comfort stretch and recovery that does not restrict your movement, having a fabric that is wrinkle free that makes your transition possible from one activity to another activity seamlessly is also convenient for wearers as well as having a fabric that provides soft/comfort touch to your skin.

It is thus highly desired to be provided with improved fabrics that reduce wrinkles.

SUMMARY

It is provided a fabric comprising a face side and a back side, said fabric comprising a multifilament yarn having a bi-component polymer core yarn which gives a mechanical stretch which is combined with a mechanical stretch yarn with mechanical stretch from texturizing; and a high moisture regain yarn with greater fiber weight per filament or higher surface area than the multifilament yarn, wherein the high moisture regain yarn is inserted such that a plurality of long high moisture regain yarn floats is generated, wherein a majority of the long high moisture regain yarn floats are on the back side of the fabric.

In an embodiment, the bi-component polymer yarn is a combination of a polyester, polyacrylic, Polytrimethylene terephthalate, nylon, a polypropylene, an acrylic and any blend combination thereof.

In a further embodiment, the bi-component polymer yarn comprises a recycled polyester.

In a further embodiment, the mechanical stretch yarn with mechanical stretch from texturizing comprises a recycled polymer.

In another embodiment, the mechanical stretch polymer is a blend of a bio polymer with synthetic polymer.

In a further embodiment, the mechanical stretch polymer is a bicomponent yarn.

In an embodiment, the bi-component yarn is air-textured or twisted with a mechanical stretch yarn.

In another embodiment, the air-textured yarn comprises about 10-80% bio polymer.

In a further embodiment, the fabric is woven and wherein the bi-component core yarn together with mechanical stretch yarn is inserted as a warp yarn and a weft yarn, and wherein the high moisture regain yarn is inserted as the weft yarn.

In an embodiment, the fabric is woven and wherein the bi-component core yarn together with mechanical stretch yarn is inserted as a warp yarn and a weft yarn, and wherein the high moisture regain yarn is inserted as the warp yarn.

In an embodiment, the fabric is woven and wherein the bi-component core yarn together with mechanical stretch yarn is inserted as a warp yarn and a weft yarn, and wherein the high moisture regain yarn is inserted as the warp yarn and the weft yarn.

In another embodiment, the bi-component core yarn together with mechanical stretch yarn is 15D/50F yarn to 120D/125F yarn such that a denier per filament of the yarn is in a range of 0.35-0.99Denier/Filament.

In a further embodiment, the bi-component core yarn together with mechanical stretch yarn is 85D/106F micro polyester blend.

In an embodiment, the high moisture regain yarn is selected from a high moisture regain synthetic polymer, a regenerated cellulosic fiber and a natural fiber.

In an embodiment, the high moisture regain yarn is selected from a high moisture regain nylon, acrylic, cotton, silk, wool, modal, micro-modal, rayon, lyocell, viscose, cupro, artificial silk or any combination thereof.

In another embodiment, the high moisture regain yarn is nylon with 20Denier to 120Denier yarn size.

In a further embodiment, the woven fabric comprises insertions and the high moisture regain yarn is introduced in every other insertions.

In an embodiment, the high moisture regain yarn is introduced every $2^{nd}$, $3^{rd}$, $4^{th}$, $5^{th}$ or $6^{th}$ insertion.

In another embodiment, 60% of the moisture regain yarn is on the back side of the fabric and 40% of the moisture regain yarn is on the face side creating denier gradient channels between the back and the face sides to remove moisture away from the back side and out of the face side of the fabric.

In a further embodiment, 90% of the moisture regain yarn is on the back side of the fabric and 10% of the moisture regain yarn is on the face side creating denier gradient channels between the back and the face sides to remove moisture away from the back side and out of the face side of the fabric.

In an embodiment, the back side of the woven fabric is mechanically sueded using sandpaper.

In an embodiment, the bi-component yarn together with the mechanical stretch yarn is dyed.

In a further embodiment, the fabric is dyed.

In another embodiment, the fabric is dyed using cationic dyable yarns and cationic dyes.

It is further provided an air-textured multifilament yarn comprising a core yarn air-textured with a mechanical stretch feed yarn, wherein the mechanical stretch yarn is a modified blend of a bio polymer with synthetic polymer.

In an embodiment, the mechanical stretch feed polymer yarn is a bi-component yarn.

In another embodiment, the mechanical stretch feed polymer yarn is a modified polyester comprising 10%-70% bio-polyester or a polyester derivative.

In a further embodiment, the mechanical stretch feed polymer yarn is 30-70D modified polyester.

In an embodiment, the mechanical stretch feed polymer yarn is 50D/34F a bi-component yarn fully drawn yarn.

In an embodiment, the mechanical stretch feed polymer yarn is 50D/34F bi-component yarn that is draw texturized yarn.

In a supplemental embodiment, the core yarn is a recycled polyester 30D/72F draw textured yarn.

In an embodiment, the air-textured multifilament yarn is 15D/50F yarn to 120D/125F yarn such that denier per filament of the yarn is in a range of 0.35-0.99Denier/Filament.

In another embodiment, air-textured multifilament yarn is 85D/106F micro polyester yarn.

It is further provided a fabric comprising the air-texturized multifilament yarn as described herein.

It is also provided an apparel comprising the woven fabric as described herein.

In an embodiment, the apparel is a shirt, a headwear, a coat, a jacket, a pant, an underwear, a glove, a sock, or a footwear.

BRIEF DESCRIPTION OF THE DRAWINGS

Reference will now be made to the accompanying drawings.

DETAILED DESCRIPTION

The present application discloses a unique fabric that has a comfort stretch and recovery level of for example, comfort stretch in both warp and weft direction of about 8 to 20%, and recovery of more than 95%.

The fabric provided herein has moisture management, having high moisture regain fiber next to the skin for comfort plus the combination of special texturized bi-component polyester yarn that has mechanical stretch and a mechanical stretch yarn that also has mechanical stretch that confers to the fabric mechanical properties (comfort stretch) plus good recovery. The fabric is naturally anti-wrinkle due to the combination of mechanical stretch polyester and bi-component yarns.

The fabric provided herein comprises different sets of yarns, a yarn comprising a bi-component core yarn with mechanical stretch which is air texturized with a mechanical stretch yarn that gets mechanical stretch from a texturizing technique. The weft yarns are interwoven with the warp yarns such that the woven fabric defines a face side and a back side opposite to the face side. The high moisture regain yarn is inserted such that it generates plurality of long high moisture regain yarn floats such that a majority of the long high moisture regain yarn floats are on the back side of the woven fabric. The high moisture regain yarn can be inserted in weft or in warp direction or can alternate or at different intervals such that the longer floats are on the backside for more exposure to the skin.

In one aspect a woven fabric is provided. The woven fabric can comprise a bi-component core yarn, such as for example a synthetic polymer core yarn, air-textured with a mechanically stretched feed polymer yarn, and a high moisture regain yarn with greater fiber weight and size per filament than the air-textured bi-component yarn. The yarns are interwoven such that the woven fabric defines a face side and a back side opposite to the face side. The high moisture regain yarn is inserted so that it generates plurality of long high moisture regain yarn floats with a majority of the long high moisture regain yarn floats being on the back side of the woven fabric.

The bi-component yarn as defined and encompassed herein is spun using two different polymers spun together side by side that provides mechanical stretch due to the differential shrinkage between the two different polymers.

In an embodiment, a mechanical stretch yarn which gets its mechanical stretch from texturizing is combined with the bi-component core yarn.

In an embodiment, a mechanical stretch yarn is a bi-component yarn combined with the bi-component core yarn.

Figure 1:
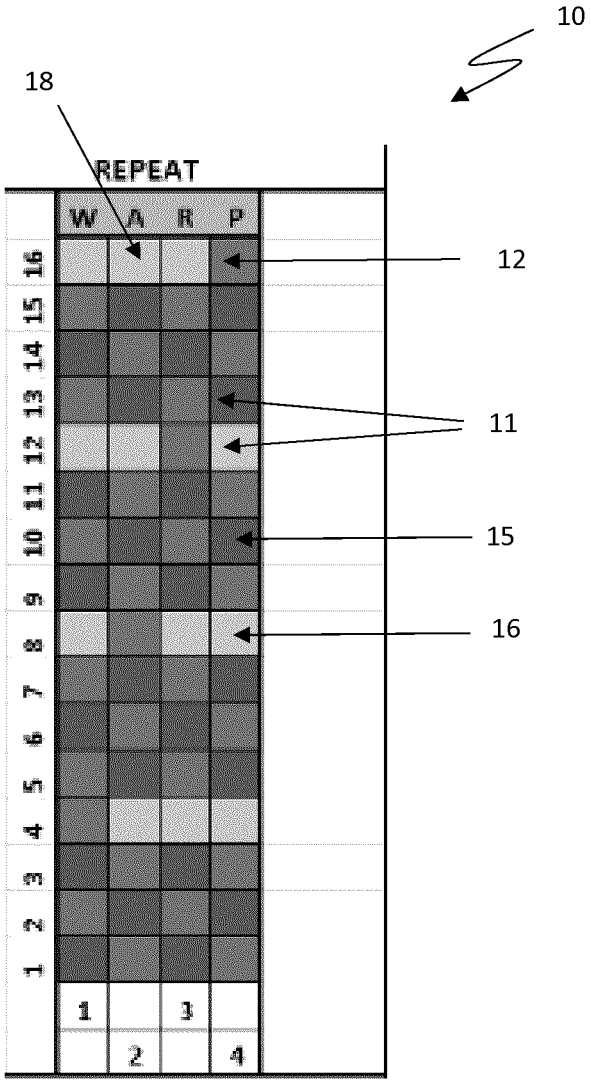
FIG. 1 illustrates a schematic representation of a woven fabric as encompassed herein in accordance to an embodiment.

As depicted in FIG. 1, it is shown a schematic representation of a woven fabric 10 with warp yarn 12 colored and a plurality of weft yarns 11 (colored differently). The warp yarn 12 in a multifilament yarn with a bi-component polymer core yarn 21 (see FIG. 2) that is air-textured with a mechanically stretched feed polymer 22. One of the plurality of weft yarns 15 (colored blue) can be same as the wrap yarn 12, such as the multifilament yarn with bi-component polymer core yarn 21 that is air-textured with a mechanically stretched feed polymer 22. The plurality of weft yarns 11 also comprise a high moisture regain yarn 16 (colored in yellow). The additional, high moisture regain weft yarn 16 has greater fiber weight and size per filament than the warp yarn 12 and the weft yarn 15. The plurality of weft yarns 11 are interwoven with the warp yarn 12 such that the woven fabric 10 has a face side that is facing the environment (away from wearer) and a back side opposite of the face side and closer to the wearer. It is encompassed in an embodiment that weft yarns 15, 16 can be woven in warp direction (be warp yarns) while the warp yarn 12 can be woven in weft direction (be a weft yarn). In some implementations, the fabric can be knitted such that the high moisture regain yarn 16 is knitted so that it generates a plurality of long high moisture regain yarn floats majority of which are on the back side of the fabric.

The high moisture regain yarn 16 is woven such that it is inserted every $2^{nd}$, $3^{rd}$, $4^{th}$, $5^{th}$ or $6^{th}$ weft insertion (or in some implementations warp insertion) such that a plurality of long high moisture regain yarn floats 18 are generated. For example, in the illustrated scheme of the woven fabric 10 of FIG. 1, the yarn 16 is woven every $4^{th}$ weft inserts creating the long floats 18. A majority of the long high moisture regain yarn floats are positioned on the back side of the woven fabric 10, to remove moisture away from the back side and out of the face side of the fabric 10. As encompassed herein, different fabric structures can be used to generate high moisture regain yarn exposure on the back side of the fabric 10 to remove moisture away from the wearer's skin.

The bi-component core polymer yarn 21 in the multifilament yarn 12, or 15 can be combination of any suitable polymer, such as for example, a polyester, a polyacrylic, Polytrimethylene terephthalate (PTT), nylon, a polypropylene, an acrylic or any blend combination thereof. In one implementation the bi-component polymer yarn 21 can comprise a recycled polyester. For example, the recycled polyester can be 20-80 denier (D) to 20-200 filaments (F). In one embodiment, the bi-component core polymer yarn 21 in the yarn 12, or 15 can be recycled polyester 30D/72F, draw textured yarn (DTY).

Figure 2:
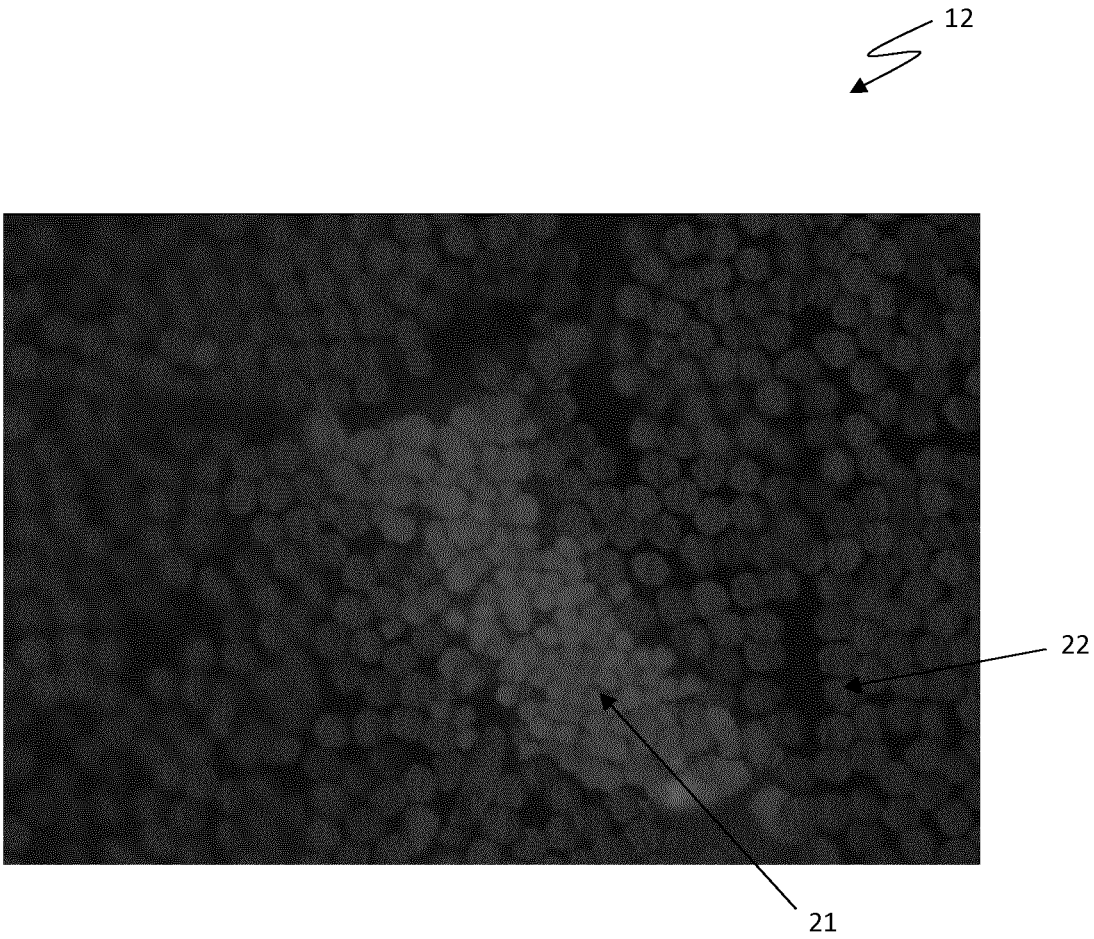
FIG. 2 is a microscopic photo of a yarn used in the woven fabric of FIG. 1 in accordance to an embodiment.

The mechanical stretch feed polymer 22 in the multifilament yarn 12, 15 can be any suitable polymer. In one implementation, the mechanical stretch feed polymer 22 can be a blend of a bio polymer with synthetic polymer, or a blend of a two different polymers such as a bi-component yarn, or polymer derivative like a Polytrimethylene terephthalate. For example, the mechanical stretch feed polymer 22 can comprise about 7-80% bio polymer. The multifilament yarn 12, 15 can be a 10-90% bio polymer and 10-90% synthetic polymer. A denier per filament of the yarn 12, 15 can be in a range of 0.35-0.99D/F. For example, the multifilament yarn 12, 15 can be 15D/50F yarn to 120D/125F yarn. In one embodiment, the bi-component yarn can be 85D/106F air-textured with mechanical stretch polyester. FIG. 2 shows a microscopic photo of the yarn 12, showing the bi-component polymer core yarn 21 air-textured with the mechanical stretch feed polymer 22.

In one implementation, the yarn 12, 15 can be formed by twisting the mechanical stretch polymer yarn 22 about the bi-component core polymer yarn 21.

As illustrated in FIG. 1, one of the weft yarns in the plurality of the weft yarns 11 can be the same as the wrap yarn 12 described herein above. The high moisture regain weft yarn 16 can be any suitable high moisture regain synthetic polymer, a regenerated cellulosic fiber or a natural fiber. For example, the high moisture regain yarn 16 can be high moisture regain nylon, acrylic, cotton, silk, wool, modal, micro-modal, rayon, lyocell, viscose, cupro, artificial silk or any combination thereof. In one implementation, the high moisture regain yarn 16 can be 20D-120D nylon. The fiber weight per filament of the high moisture regain yarn 16 can be in a range of 0.5D/F-2.5D/F. For example, the high moisture regain yarn 16 can be nylon 100D/72F with fiber weight per filament of about 1.4D/F.

The plurality of the weft yarns 11 are interwoven with the wrap yarn 12 such that 60% of the high moisture regain yarn 16 is on the back side of the woven fabric 10 and 40% of the high moisture regain yarn 16 is on the face side of the fabric 10 thus creating denier gradient channels between the back and the face sides to remove moisture away from the back side and out of the face side of the woven fabric 10. This can also help with the wearer's comfort since the high moisture regain yarn close to wearer's skin absorbs moisture vapour and makes the fabric breathable. In one implementation, 90% of the high moisture regain yarn 16 is on the back side of the fabric 10 and only 10% of the high moisture regain yarn 16 is on the face side of the woven fabric 10. The high moisture regain yarn 16 is introduced every $2^{nd}$, $3^{rd}$, $4^{th}$, $5^{th}$ or $6^{th}$ weft insertion so that it can create the long floats 18 of high moisture regain weft yarn 16 on the back side of the woven fabric 10 to facilitate removal of the moisture away from the skin of the wearer. There can be various iteration of a woven fabric structure that can achieve this functionality where the high percentage of high moisture regain yarn is next to the wearer's skin. Because of the high moisture regain yarn 16 that is next to the skin, it provides quick drying achieving a no sweat show function to the fabric as well.

Figure 3:
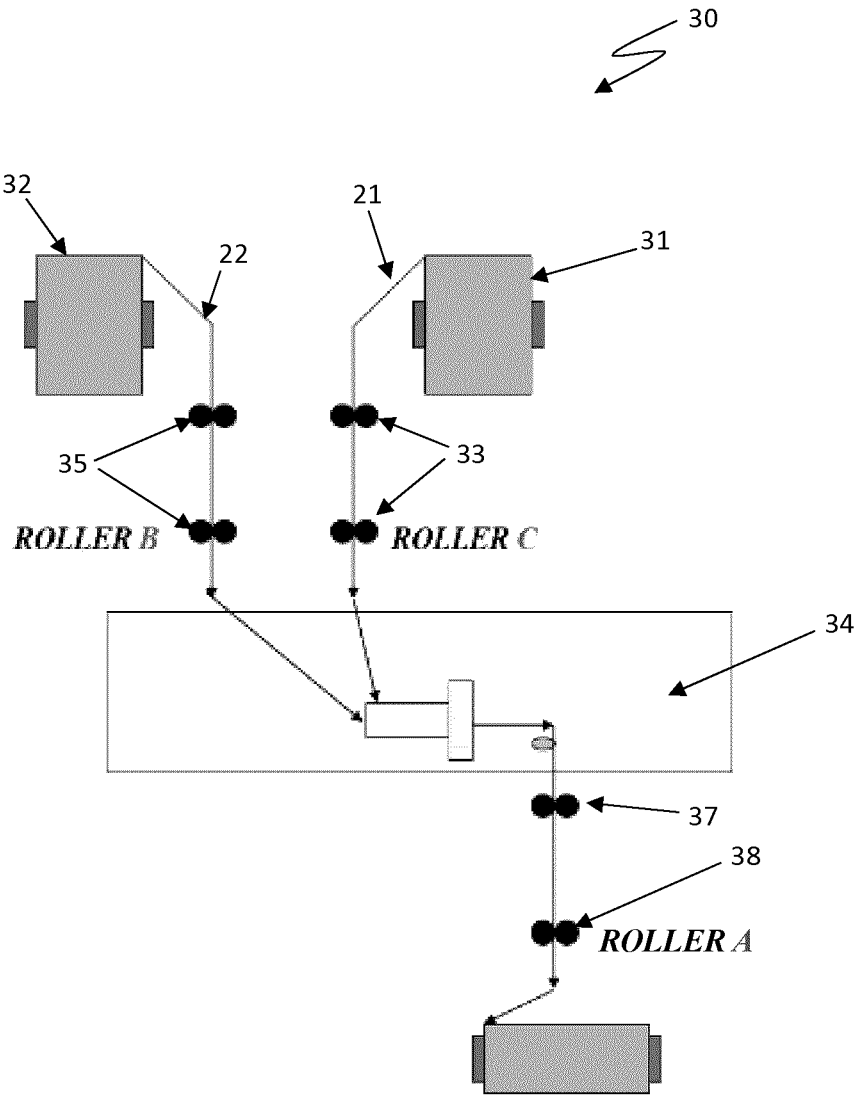
FIG. 3 is a schematic illustration of an air texturizing process of the yarn of FIG. 2 in accordance to an embodiment.

FIG. 3 illustrates an example of the air texturizing process 30 used in manufacture of the warp yarn 12 as well as one of the weft yarns, e.g., weft yarn 15. A supply 31 of the bi-component core synthetic yarn 21 is provided into an air-textured nozzle 34 through a number of feed rollers 33. The nozzle 34 can be a "Y" shaped nozzle. The mechanical stretch yarn 22 from a supply 32 and through a number of feed rollers 35 is fed into the air-textured nozzle 34 under 45° air jet (compressed air) with some moisture (water spray) to get the yarns 21 and 22 entangled together and create high bulk and volume of the yarn 12, 15. The percentage of the feeding yarn 22 is controlled so that the resulting yarn is not too bulking (too big of a loops) to avoid yarn instability and peeling problems. The core yarn 21 is fed to a lower degree of overfeed and the feed yarn 22 is fed at higher degree of overfeed (the speed of the feed roller C is lower than the speed of the feed roller B) so that the core yarn 21 is less textured and provide yarn tension while the mechanical stretch feed yarn 22 creates loops to create bulk and volume. The overfeed range of the mechanical stretch feed yarn 22 to the core yarn is about 10-25%. The yarns 21 and 22 are converted into textured yarn in the air-textured nozzle 34 by the supersonic air jet. The created textured yarn is then stabilized between delivery rollers 37 and take-up rollers 38 by a faster rotation of the take-up rollers 38. For example, during the stabilization the yarn 36 is extended (e.g., 2-8%) to mechanically remove the loose loops and improve the air-textured yarn stability. For example, the speed of the take-up rollers can be about 450-550 m/min. This process of texturizing helps with air permeability and a hand-feel closer to cotton.

Figure 4:
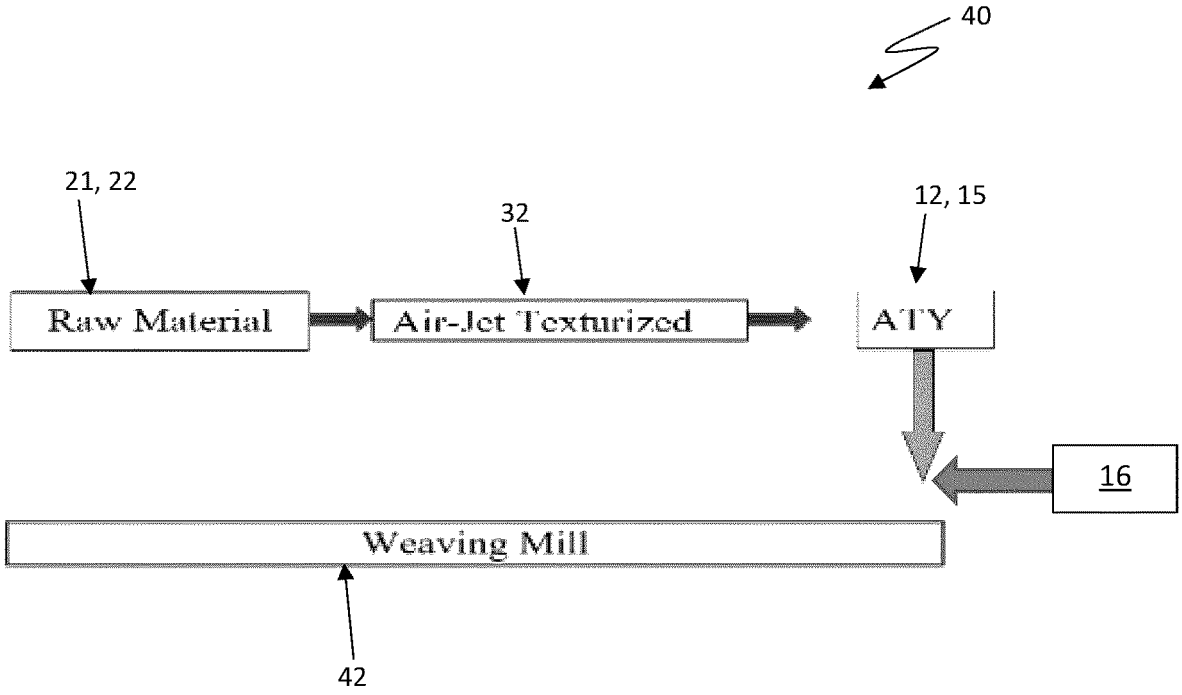
FIG. 4 is a schematic illustration of a manufacturing process of a woven fabric in accordance to an embodiment.

FIG. 4 illustrates an example of the manufacturing process 40 used in manufacture of the woven fabric 10. The raw materials, such as the synthetic core polymer yarn and the mechanical stretch feed yarn 22 are first air-textured (or in some implementations twisted) as described herein above so that the created air textured polymer yarn can be used as wrap yarn 12 and one of the weft yarns 15. The yarn 12, 15 and the high moisture regain yarn 16 are then woven in the weaving mill using a weaving machine with dobby attachment that enables the desired construction of the fabric as described herein above. The same or similar fabric construction can be achieved using a jacquard attachment as well as various other weaving techniques.

In some embodiments, the obtained yarn 12, 15 can then be dyed at a pre-determined process parameters such that the yarn can retain the mechanical stretch and elongation properties. The dyeing process can comprise a dyeing machine in which spools of bi-component yarn combined with the mechanical stretch yarn are inserted. The spool package winding tension can be about 4-8 grams. For example, the yarn winding tension in the spool can be 6 grams. The dyeing temperature can be between 100° C.-150° C. at pressure of 1-2 bars for about 15-35 minutes. In an embodiment, to achieve yarn dyes stripes and checks, these mechanical stretch yarns are dyed using a special dyeing technique where the yarn package is wound with less tension 4 to 8 grams, the yarn is dyed at slightly lower temperature around 125 to 135 degree centigrade with dyeing time of about 20 to 30 minutes and the dyeing vessel pressure of about 1.25 to 1.75 bars. This technique makes sure that the mechanical stretch and wrinkle resistant properties of the fabric are maintained as provided in Table 1 below.

TABLE 1

| Characterization of a yarn dyed fabric: | | | | |
|---|---|---|---|---|
| Test Name | Test Method | Standard | Test Results | Test Details |
| The Elasticity of Fabrics: Strip Tests | BS EN ISO 20932 -MOD | Modulus10% EXTENSION @ woven/knits with elastic fibers (Warp) | 2090.4 | gram |
| | | Modulus10% EXTENSION @ woven/knits with elastic fibers (Weft) | 2151.7 | gram |
| | | Modulus30% EXTENSION @ woven/knits with elastic fibers (Warp) | over 3060 | gram |
| | | Modulus30% EXTENSION @ woven/knits with elastic fibers (Weft) | over 3060 | gram |
| | | Modulus50% EXTENSION @ woven/knits with elastic fibers (Warp) | over 3060 | gram |
| | | Modulus50% EXTENSION @ woven/knits with elastic fibers (Weft) | over 3060 | gram |
| | | Modulus80% EXTENSION @ woven/knits with elastic fibers (Warp) | over 3060 | gram |
| | | Modulus80% EXTENSION @ woven/knits with elastic fibers (Weft) | over 3060 | gram |
| | | EXTENSION @ woven/knits with elastic fibers (Warp) | 11.7 | % |
| | | EXTENSION @ woven/knits with elastic fibers (Weft) | 11.3 | % |
| | | RECOVERY 60 S @ woven/knits with elastic fibers (Warp) | 95.7 | % |
| | | RECOVERY 60 S @ woven/knits with elastic fibers (Weft) | 95.6 | % |
| | | RECOVERY 30 min @ woven/knits with elastic fibers (Warp) | 97.9 | % |
| | | RECOVERY 30 min @ woven/knits with elastic fibers (Weft) | 97.8 | % |
| Wicking (Chemical finish)/ Moisture Management | LLL-SL-10197-MTHD | Before Wash(Warp@15 mins) | 9.8 | cm |
| | | Before Wash(Filling@15 mins) | 9.9 | cm |
| | | Before Wash(Warp@30 mins) | 12.4 | cm |
| | | Before Wash(Filling@30 mins) | 12.8 | cm |
| | | After 10 Washes(Warp@15 mins) | 12.7 | cm |
| | | After 10 Washes(Filling@15 mins) | 13.1 | cm |
| | | After 10 Washes(Warp@30 mins) | >15 | cm |
| | | After 10 Washes(Filling@30 mins) | >15 | cm |
| Wrinkle recovery of fabrics: appearance method (AATCC 128-17) | | | | |
| Black Rating | LULU-SL-992.04-GBL-MULTI PHASE-V5 Min. Grade 4 | ORIGINAL: 4.0 AFTER 20 WASHES: 4.0 | | PASS |
| Iron free (AATCC 128-17 (Mod)) | | | | |
| AFTER 20 WASHES Black Rating | LULU-SL-992.04-GBL-MULTI PHASE-V5 Min. Grade 4 | Grade 4 | | PASS |

Figure 5:
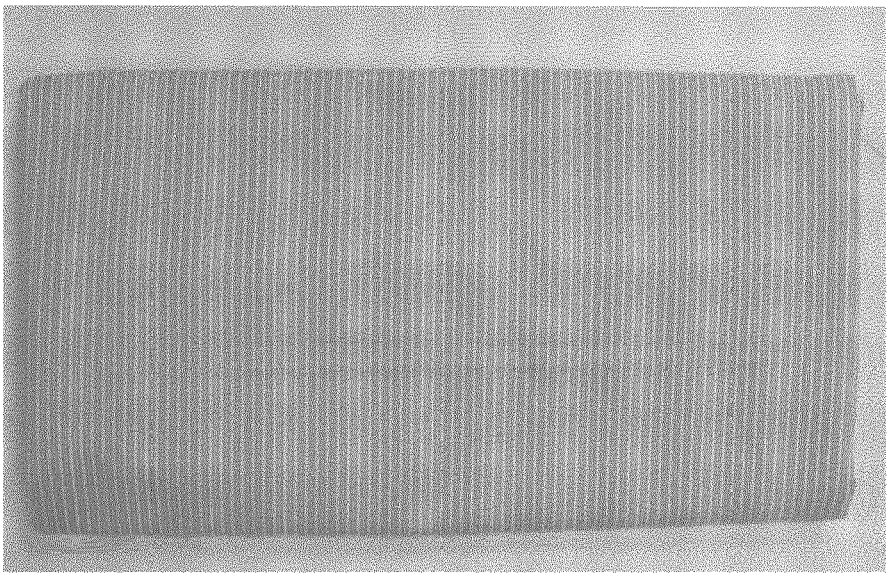
FIG. 5 illustrates a picture of a dyed fabric sample with cationic dyes comprising cationic dyeable yarns in accordance to an embodiment.

For example, the duration of the dyeing process can be 25 minutes at 130° C. dyeing temperature at 1.5 bar pressure in the machine. In another embodiments, the fabric can be dyed using cationic dyes. For example, cationic dyeable polymer yarn, for example cationic dyeable polyester yarn, can be used in the warp direction while ordinary polymer yarn, e.g., ordinary polyester or nylon, can be used in the weft direction. When the fabric is then dyed with cationic dyes the cationic dyeable yarns will be dyed creating striped pattern in the fabric (see FIG. 5).

Dyeing the fabric using cationic dyes as per the process described herein above, allows to retain the mechanical and elongation properties of the bi-component yarns without going through the yarn dyeing process when tested for e.g. dimensional change of fabrics after home laundering (as per AATCC 135).

The yarn dyed strip can also be achieved using cationic dyeable mechanical stretch polyester yarns. Results from a solid dyed yarn fabric characterization are shown in the table 2 below.

TABLE 2

| Characterization of yarn dyeing properties. | | | | |
|---|---|---|---|---|
| Test Name | Test Method | Standard | Test Results | Test Details |
| Extension, Modulus & Recovery | BS 4952 | Stretch(Warp) | 23.8 | |
| | | Stretch(Filiing) | 13.8 | |
| | | Growth(Warp) | 2.5 | |
| | | Growth(Filiing) | 1.9 | |
| | | Recovery(Warp) | 89.5 | |
| | | Recovery(Filiing) | 86.2 | |

TABLE 2-continued

Characterization of yarn dyeing properties.

| Test Name | Test Method | Standard | Test Results | Test Details |
|---|---|---|---|---|
| Extension, Modulus & Recovery | ISO EN 14704-1 | 10% ELONGATION(Warp) | 357.1 | gram |
| | | 10% ELONGATIONh(Filiing) | 1405.7 | gram |
| | | EXTENSION(Warp) | 23.2 | % |
| | | EXTENSIONh(Filiing) | 13.2 | % |
| | | RECOVERY 60 S(Warp) | 95.7 | % |
| | | RECOVERY 60 S(Filiing) | 96.2 | % |
| | | RECOVERY 30 min(Warp) | 97.9 | % |
| | | RECOVERY 30 min(Filiing) | 98.1 | % |
| Wicking- Byreck Method | JIS L1907 Section7.1.2 | Before Wash(Warp@30 mins) | 17.5 | cm |
| | | Before Wash(Filling@30 mins) | 18.8 | cm |
| | | After 10 Washes(Warp@30 mins) | 14.2 | cm |
| | | After 10 Washes(Filling@30 mins) | 14.7 | cm |
| Vertical Wicking | LLL 10197 | Before Wash(Warp@15 mins) | 12.1 | cm |
| | | Before Wash(Filling@15 mins) | 15.0 | cm |
| | | After 10 Washes(Warp@15 mins) | 9.9 | cm |
| | | After 10 Washes(Filling@15 mins) | 10.9 | cm |

As encompassed herein, the woven fabric 10 described herein can be used in any type of articles of apparel including shirts, headwear, coats, jackets, pants, underwear, gloves, socks, and footwear. The fabric is naturally anti-wrinkle due to the combination of mechanical stretch polyester and bi-component yarns.

While the disclosure has been described in connection with specific embodiments thereof, it will be understood that it is capable of further modifications and this application is intended to cover any variations, uses, or adaptations including such departures from the present disclosure as come within known or customary practice within the art and as may be applied to the essential features hereinbefore set forth, and as follows in the scope of the appended claims.

What is claimed is:

1. A woven fabric comprising a face side and a back side, said woven fabric comprising:

warp yarns interwoven with weft yarns;

the warp yarns including;

a warp combination yarn comprising a bi-component core yarn and a texturized multifilament feed yarn texturized with or twisted with the bi-component core yarn;

the weft yarns including:

a first weft multifilament yarn; and a second weft multifilament yarn comprising regenerated cellulosic filaments or synthetic polymer filaments, wherein a denier per filament of the second weft multifilament yarn is greater than a denier per filament of the warp combination yarn;

wherein the woven fabric includes weft insertions of the first weft yarn and weft insertions of the second weft yarn, the weft insertions of the second weft yarn form a plurality of weft yarn floats every second, third, fourth, fifth, or sixth weft insertion;

wherein a majority of the weft yarn floats are on the back side of the woven fabric, the weft yarn floats on the back side of the woven fabric act to remove moisture from the back side of the woven fabric and out of the face side of the woven fabric; and wherein the face side of the woven fabric is configured to face away from a wearer and the back side of the woven fabric is configured to be closer to the wearer.

2. The woven fabric of claim 1, wherein a polymer of the bi-component core yarn of the warp combination yarn comprises a polyester, a polyacrylic, a Polytrimethylene terephthalate, a nylon, a polypropylene, an acrylic or any blend or combination thereof.

3. The woven fabric of claim 1, wherein a polymer of the bi-component core yarn comprises a recycled polyester.

4. The woven fabric of claim 1, wherein a polymer of the bi-component core yarn of the warp combination yarn comprises about 10-80% of the bio polymer.

5. The woven fabric of claim 1, wherein the first weft multifilament yarn is the same yarn as the texturized multifilament feed yarn of the warp combination yarn.

6. The woven fabric of claim 1, wherein the texturized multifilament feed yarn is a bi component yarn.

7. The woven fabric of claim 1, wherein the texturized multifilament feed yarn of the warp yarn combination yarn comprises a blend of a bio polymer with a synthetic polymer.

8. The woven fabric of claim 1, wherein the warp combination yarn has a denier per filament in a range of 0.35-0.99.

9. The woven fabric of claim 1, wherein the bi-component core yarn of the warp combination yarn is an 85 denier/106 filament bi-component polyester.

10. The woven fabric of claim 9, wherein the woven fabric comprises insertions of the second weft multifilament yarn in every other insertion.

11. The woven fabric of claim 1, wherein 60% of the plurality of weft yarn floats are on the back side of the woven fabric and 40% of the plurality of weft yarn floats are on the face side of the woven fabric.

12. The woven fabric of claim 1, wherein 90% of the plurality of weft yarn floats are on the back side of the woven fabric and 10% of the plurality of weft yarn floats are on the face side of the woven fabric.

13. The woven fabric of claim 1, wherein the warp combination yarn is dyed; or wherein the woven fabric is dyed.

14. The woven fabric of claim 1, wherein the denier per filament of the second weft yarn ranges from 0.5 to 2.5.

15. The woven fabric of claim 1, wherein the second weft yarn is the multifilament yarn including the nylon filaments and has a yarn size ranging from 20 denier to 120 denier.

16. The woven fabric of claim 1, wherein the texturized multifilament feed yarn is a 50D/34F bi-component yarn.

17. The woven fabric of claim 1, wherein the bi-component core yarn is a recycled polyester 30D/72F bi-component drawn textured yarn.

18. The woven fabric of claim 1, wherein the second weft yarn is the multifilament yarn including the nylon filaments and is a 100 denier/72 filament nylon yarn with a denier per filament of about 1.4.

19. An article of apparel comprising the woven fabric of claim 1.

* * * * *